US005857402A

United States Patent [19]

Hoshida et al.

[11] Patent Number: 5,857,402

[45] Date of Patent: Jan. 12, 1999

[54] VARIABLE DISPLACEMENT COMPRESSOR METHOD AND APPARATUS

[75] Inventors: Takahiro Hoshida; Shigeki Kanzaki; Kazushige Murao, all of Kariya, Japan

[73] Assignee: Kabushiki Kaisha Toyoda Jidoshokki Seisakusho, Kariya, Japan

[21] Appl. No.: 905,579

[22] Filed: Aug. 4, 1997

[30] Foreign Application Priority Data

Aug. 5, 1996 [JP] Japan ..... 8-205811

[51] Int. Cl.[6] ..... F01B 3/00

[52] U.S. Cl. ..... 92/12.2; 92/71; 91/505

[58] Field of Search ..... 92/12.2, 13.4, 92/13.41, 71; 91/504, 505

[56] References Cited

U.S. PATENT DOCUMENTS

| | | | |
|---|---|---|---|
| 4,168,653 | 9/1979 | Hein et al. | 92/12.2 |
| 4,911,063 | 3/1990 | Kawahara et al. | 92/12.2 |
| 5,184,536 | 2/1993 | Arai | 92/12.2 |

FOREIGN PATENT DOCUMENTS

| | | | |
|---|---|---|---|
| 59-113274 | 6/1984 | Japan | 92/12.2 |
| 210314 | 3/1990 | Japan . | |

*Primary Examiner*—Thomas E. Denion

*Attorney, Agent, or Firm*—Brooks Haidt Haffner & Delahunty

[57] ABSTRACT

A variable displacement compressor includes an inclining swash plate connected to a drive shaft. A rotor rotates integrally with the drive shaft. A guiding mechanism is provided between the swash plate and the rotor to guide the inclination of tho swash plate between a minimum inclination position and a maximum inclination position and thus change the stroke of the piston. An abutment is provided to restrict the inclination of the swash plate. In another embodiment, a cap included in the guiding mechanism determines the maximum inclination position of the swash plate. In one embodiment, the maximum inclination position is determined by the length of a spring arranged between the swash plate and the rotor. In another embodiment, a spacer is arranged between the swash plate and the rotor. The thickness of the spacer determines the maximum inclination position. The maximum displacement of the compressor can be changed by changing only one part.

10 Claims, 5 Drawing Sheets

VARIABLE DISPLACEMENT COMPRESSOR METHOD AND APPARATUS

BACKGROUND OF THE INVENTION

The present invention relates to a variable displacement compressor, and more particularly, to a variable displacement compressor that changes the stroke of pistons by changing tho inclination of a swash plate to vary the compressor displacement.

In a variable displacement swash plate compressor, a drive shaft is rotatably supported in a housing. The housing includes a cylinder block that is provided with cylinder bores. The swash plate is coupled to the drive shaft and supported in a manner enabling inclination of the swash plate with respect to the drive shaft. A piston is reciprocally accommodated in each cylinder bore. The swash plate is coupled to each piston. A rotor is fixed to the drive shaft in the housing to rotate integrally with the drive shaft. A guide mechanism is provided between the swash plate and the rotor to restrict relative rotation therebetween and guide the inclination of the swash plate. The inclination of the swash plate is adjusted to change the stroke of the pistons. This varies the compressor displacement between a maximum value and a minimum value. The compressor displacement becomes maximum when the inclination of the swash plate is restricted by the abutment of the swash plate against the rotor. In this state, the swash plate is located at a maximum inclination position.

The compressors are manufactured in accordance with their maximum displacement. Thus, when manufacturing a variety of compressors that differ in maximum displacement, each compressor must be manufactured differently in accordance with the maximum displacement. More specifically, to manufacture compressors that differ in maximum displacement, the shape and number of the cylinder bores must be altered. Thus, when manufacturing a variety of compressors that differ in maximum displacement, the design of each variety of compressor must be significantly changed. Furthermore, the shape and size of components having the same functions differ between compressors of different maximum displacements. Accordingly, an exclusive production line must be provided for each differing maximum displacement. Thus, the production of a variety of compressors having different displacements results in significantly increased costs, which increases the cost of each compressor.

SUMMARY OF THE INVENTION

Accordingly, it is an objective of the present invention to provide compressors having different maximum compressor displacements that may be manufactured in a facilitated and inexpensive manner.

To achieve the above objective, the present invention provides an adjustable variable displacement compressor apparatus. The apparatus includes a housing, a cylinder bore defined in the housing, a piston accommodated in the cylinder bore, a drive shaft rotatably supported in the housing, and a awash plate fitted to the drive shaft and supported to rotate integrally with the drive shaft while inclining. The rotation of the swash plate causes reciprocation of the piston to draw refrigerant gas into the cylinder bore and to compress the drawn in gas. The piston has a stroke that changes as the swash plate inclines. The apparatus further includes a rotor that rotates integrally with the drive shaft, a guiding mechanism provided between the swash plate and the rotor to guide the inclination of the swash plate to permit the swash plate to shift between a minimum inclination position and a maximum inclination position, and a restricting means for determining the maximum inclination position of the swash plate. The maximum inclination position of the swash plate is determined by installing a selected one of the restricting means in the housing.

BRIEF DESCRIPTION OF THE DRAWINGS

FIG. 2(*b*) is a view showing a further rotor;

DETAILED DESCRIPTION OF THE PREFERRED EMBODIMENTS (First Embodiment)

A first embodiment of a compressor according to the present invention will now be described with reference to FIGS. 1 to 3.

Figure 1:
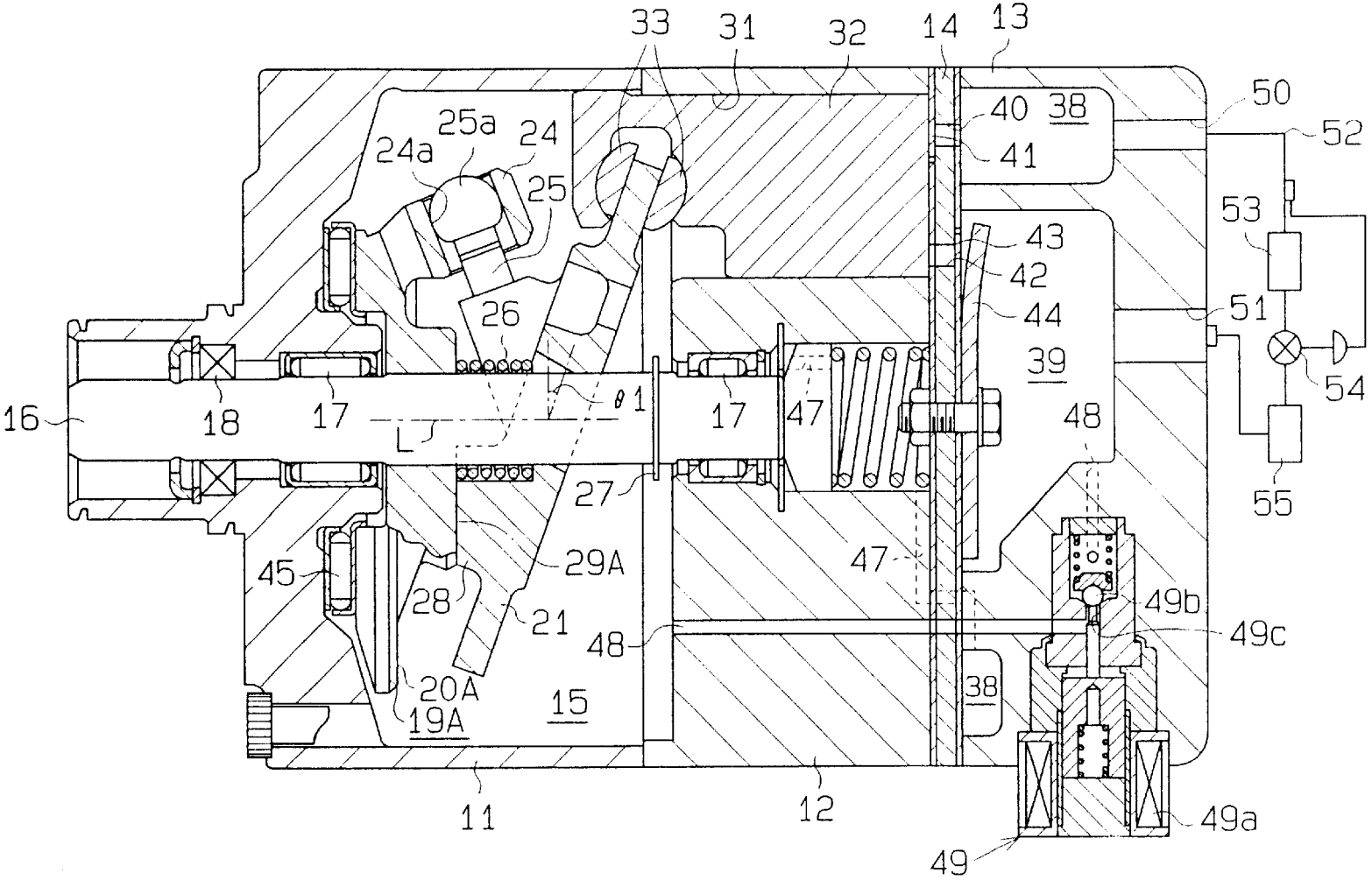
FIG. 1 is a cross-sectional view showing a variable displacement compressor.

As shown in FIG. 1, a front housing 11 is fixed to the front end of a cylinder block 12. A rear housing 13 is fixed to the rear end of the cylinder block 12 with a valve plate 14 arranged therebetween. A crank chamber 15 is defined in the front housing 11 and the cylinder block 12.

A plurality of cylinder bores 31 (only one shown) extend through the cylinder block 12. A single-headed piston 32 is accommodated in each cylinder bore 31.

A drive shaft 16 is rotatably supported by means of bearings 17 in the front housing 11 and the cylinder block 12. The drive shaft 16 is connected to an engine by means of an electromagnetic clutch. Accordingly, the drive shaft 16 is rotated by connecting the electromagnetic clutch to the running engine. A lip seal 18 is provided between the front portion of the drive shaft 16 and the front housing 11 to seal the crank chamber 15.

A substantially disk-like rotor 19A is fixed to the drive shaft 16 in the crank chamber 15. The rotor 19A has a pair of support arms 24 protruding toward the rear. A guide bore 24*a* extends through each support arm 24. A counterweight 20A is formed integrally with a peripheral portion of the rotor 19A. The location of the counterweight 20A is diametrically opposed to the location of the support arms 24. The counterweight 20A offsets the weight of the support arms and balances the rotor 19A.

A swash plate 21 is coupled to the drive shaft 16 and is supported so that the swash plate 16 inclines with respect to the shaft 21 and slides in the direction of the shaft axis L while rotating integrally with the drive shaft 16. The swash plate 21 is coupled to each piston 32 by means of shoes 33 to convert the rotating movement of the swash plate 21 to linear reciprocating movement of the piston 32.

The swash plate 21 has a pair of connecting pins 25. A guide 25*a* is provided at the distal end of each connecting pin 25. Each guide 25*a* is slidably retained in the guide bore 24*a* of one of the support arms 24. The guide 25*a* is guided along the wall of the associated guide bore 24*a*. This inclines the swash plate 21 with respect to the shaft axis L. The inclination of the swash plate 21 with respect to a plane perpendicular to the drive shaft 16 becomes smaller as the center of the swash plate 21 moves toward the cylinder block 12.

A coil spring 26 is arranged on the drive shaft 16 between the rotor 19A and the swash plate 21. The axis of the spring 26 coincides with the axis L of the drive shaft 16. The spring 26 urges the swash plate 26 in a direction decreasing the inclination of the swash plate 26. An annular stopper 27 is fixed to the drive shaft 16 between the swash plate 21 and the cylinder block 12. A projection 28 projects integrally from the front side of the swash plate 21 to restrict the inclination of the swash plate 21. The minimum inclination position of the swash plate 21 is restricted at the position where the swash plate 27 abuts against the stopper 27. The maximum inclination position of the swash plate 21 is restricted at the position where the projection 28 abuts against the rear side of the rotor 19A. The portion of the rotor 19A that abuts against the projection 28, or the abutment portion 29A, is shown by dotted lines in FIG. 2(*a*). As apparent from FIG. 1, the abutment portion 29A is flush with the rear surface of the rotor 19A. In other words, the abutment portion 29A does not project toward the swash plate 23 from the rotor 19A. When employing the rotor 19A, the maximum inclination angle of the swash plate 21 (the angle of the swash plate 21 with respect to a plane perpendicular to the axis L of the drive shaft 16 when located at the maximum inclination position) is set at θ1.

A suction chamber 38 and a discharge chamber 39 are defined in the rear housing 13. The valve plate 14 is provided with a suction port 40 and a suction valve 41, which opens and closes the suction port 40, for each cylinder bore 31. The valve plate 14 is also provided with a discharge port 42 and a discharge valve 43, which opens and closes the discharge port 42, for each cylinder bore 31. Reciprocation of the pistons 32 causes the refrigerant gas in the suction chamber 38 to be drawn into the cylinder bores 31 through the associated suction ports 40 and suction valves 41. Reciprocation of the pistons 32 further causes the gas drawn into the cylinder bores 31 to be discharged into the discharge chamber 39 through the associated discharge ports 42 and discharge valves 43. The opening angle (flexing angle) of the discharge valves 43 is restricted by a retainer 44.

A thrust bearing 45 is arranged between the rotor 19 and the inner wall of the front housing 11. The thrust bearing 45 receives the compression reaction acting on the rotor 19 by way of the pistons 32 and the swath plate 21.

A pressurizing passage 48 connects the discharge chamber 39 to the crank chamber 15. A displacement control valve 49 is provided in the rear housing 13 and arranged along the pressurizing passage 48. The control valve 49 includes a solenoid 49*a*, a valve body 49*b*, and a port 49*c*. When the solenoid 49*a* is excited, the valve body 49*b* closes the port 49*c*. When the solenoid 49*a* is de-excited, the valve body 49*b* opens the port 49*c*. A pressure releasing passage 47 connects the crank chamber 15 to the suction chamber 38.

An inlet 50 of the suction chamber 38 and an outlet 51 of the discharge chamber 39 are connected to each other through an external refrigerant circuit 52. The refrigerant circuit 52 includes an evaporator 53, an expansion valve 54, and an a condenser 55. The inclination of the swash plate 21 is controlled by adjusting the difference between the pressure in the crank chamber 15 and the pressure in the cylinder bores 31. Alterations in the inclination of the swash plate 21 change the stroke of the pistons 32 and adjust the compressor displacement.

The pressure of the crank chamber 15 is controlled by controlling the control valve 49 to open or close the pressurizing passage 48. The control valve 49 is controlled by a computer (not shown) in accordance with the cooling load of the refrigerant circuit 52.

When the pressurizing passeage 48 is closed, the pressure of the crank chamber 15 is released into the suction chamber 38 through the pressure releasing passage 47. Accordingly, the pressure of the crank chamber 15 decreases and approaches the pressure of the suction chamber 38. This causes the swash plate 21 to be held at the maximum inclination position. In this state, the long stroke of the pistons 32 causes the amount of refrigerant gas discharged by the pistons 32, that is the compressor displacement, to be maximum. When the pressurizing passage 48 is opened, the high pressure of the discharge chamber 39 is communicated to the crank chamber 15. This increases the pressure of the crank chamber 15 and shifts the swash plate 21 toward the minimum inclination position. In this state, the short stroke of the pistons 32 causes the compressor displacement to be minimum.

A method for manufacturing a compressor, the maximum displacement of which is smaller than the compressor of FIG. 1, will now be described.

Figure 2A:
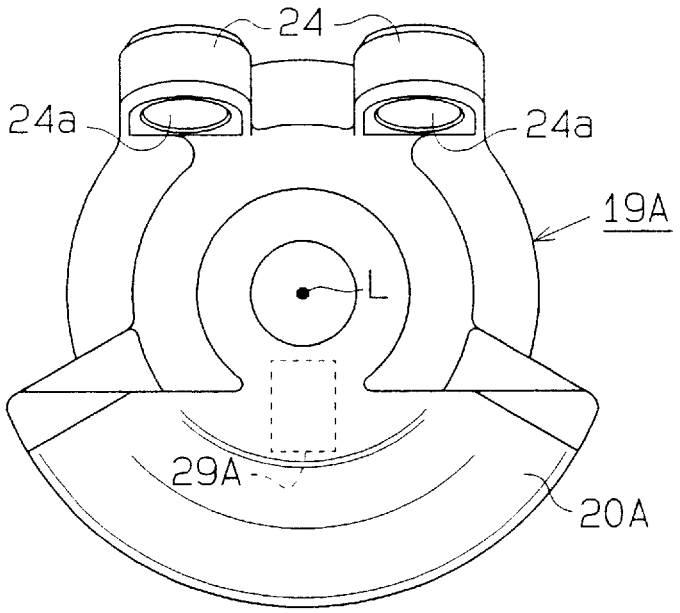
FIG. 2(*a*) is a view showing the rotor of FIG. 1.
Figure 2B:
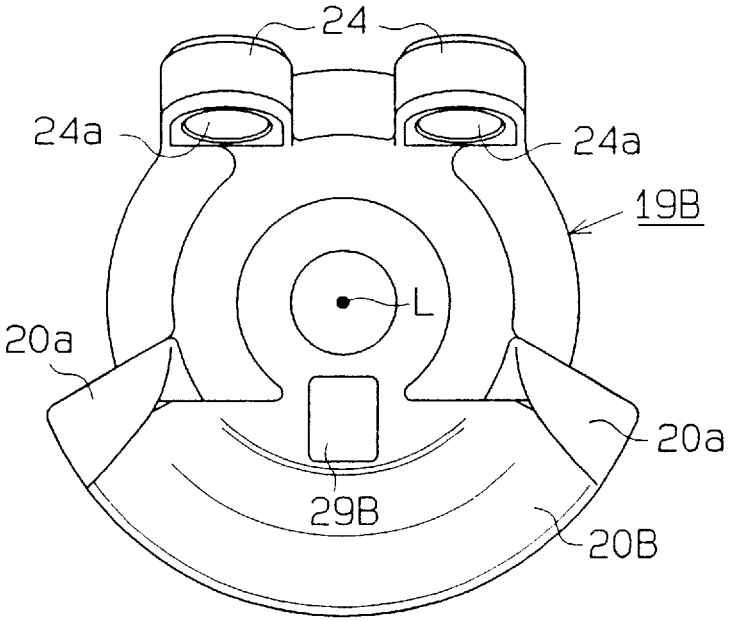

When manufacturing a compressor, the maximum displacement of which is smaller than the compressor of FIG. 1, only the rotor 19A is replaced with a rotor 19B, which is shown in FIG. 2(*b*). In other words, all the same components, except for the rotor 19A, are used to assemble both compressors. This allows common components to be used in compressors, the maximum displacements of which differ from one another.

Figure 3:
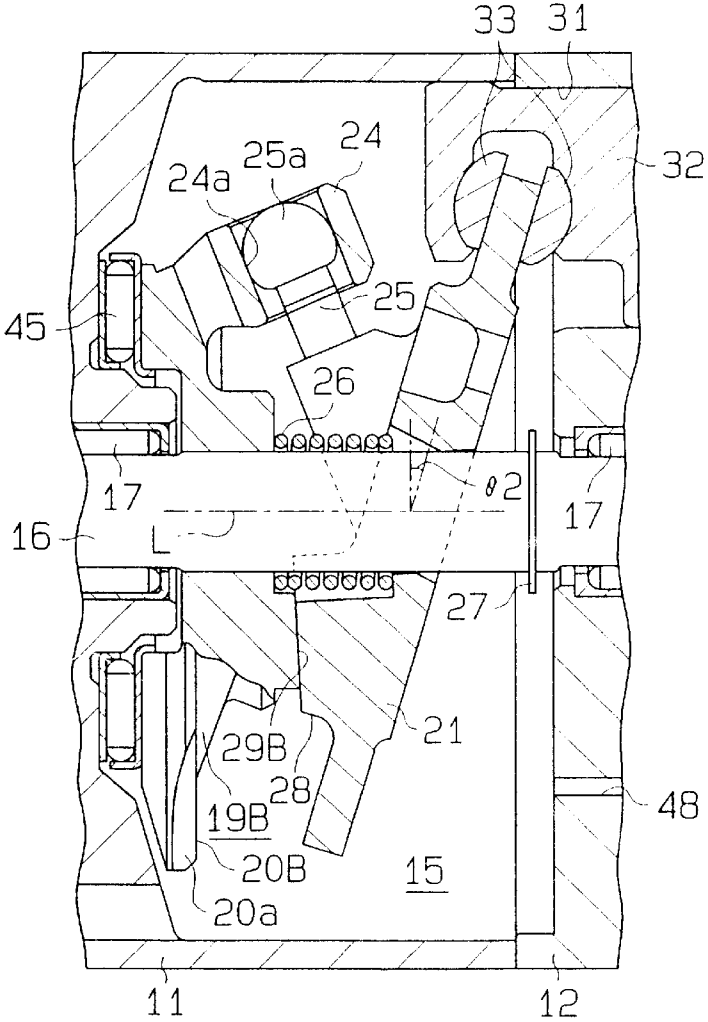
FIG. 3 is an enlarged partial cross-sectional view showing a compressor employing the rotor of FIG. 2(*b*)

The rotor 19B differs from the rotor 19A in that the abutment portion 29B projects toward the swash plate 21 (projection 28) from the rotor 19B, as shown in FIG. 3. The swash plate 21 is located at the maximum inclination position when the swash plate 21 abuts against the abutment portion 29B. When employing the rotor 19B, the maximum inclination angle of the swash plate 21 is set at θ2. The inclination angle θ2 of the swash plate 21 when abutted against the rotor 19B is smaller than the inclination angle θ1 of the swash plate 21 when abutted against the rotor 19A. Thus, in compressors employing the rotor 19B, the maximum inclination angle θ2(<θ1) causes the maximum stroke of the pistons 32 to be shorter than the maximum stroke of the pistons 32 of FIG. 1. This decreases the maximum displacement in comparison with compressors that employ the rotor 19A.

The abutment portion 29B, which projects toward the swash plate 21, increases the thickness of the rotor 19B compared to that of the rotor 19A. This increases the weight of the rotor 19B at the part where the abutment portion 29B is located. To offset the increased weight, a thin portion 20*a* is provided at each side of the abutment portion 29B in the counterweight 20B. That is, material is removed to adjust the distribution of the mass of the rotor 19B accordingly. This balances the rotation of the rotor 19B in a satisfactory manner.

The rotors 19A, 19B differ only in the axial position of the abutment portions 29A, 29B and the mass distribution of the counterweight (or the thin portions 20*a*). The dimensions and shapes of the remaining parts of the rotors 19A, 19B are identical. Accordingly, the similar shape and dimensions of the rotors 19A, 19B enable similar molds to be used when casting the rotors 19A, 19B. This facilitates the designing and machining of the molds, which are expensive to make. In some cases, the rotors 19A, 19B may be produced from the same mold. In such case, the molded product is machined to form variations in the thin portions 20*a* and the abutment portions 29A, 29B. Therefore, common molds, which enable the adjustment of the position of the abutment portion 29A, 29B and of the mass distribution of the counterweights 20A, 20B, may be used.

As described above, the compressor of this embodiment enables the following advantageous effects to be obtained.

The maximum compressor displacement is altered merely by changing the axial position of the abutment portions 29A, 29B of the rotors 19A, 19B. Accordingly, except for the rotors 19A, 19B, common components are used to assemble compressors that differ in maximum displacement. This allows the compressors to have a common design excluding the rotors 19A, 19B and enables common production lines to be used. Accordingly, compressors differing in maximum displacement are manufactured in an efficient and inexpensive manner.

The abutment portions 29A, 29B are integrally formed with the rotors 19A, 19a, respectively. This reduces the number of components in comparison to a compressor that employs a separate component to serve as the abutment portion.

The counterweights 20A, 20B are adjusted in accordance with the position of the abutment portions 29A, 29B. This satisfactorily maintains the rotating balance of the rotors 19A, 19B and enables smooth compression actions.

By preparing three or more types of rotors having abutment portions differing in position, three or more types of compressors, each differing in maximum displacement, may be manufactured. In this case, the appropriate rotor is selected from the plurality of rotors in accordance with the maximum displacement of the compressor that is to be manufactured.

The abutment portion 29B may be provided on the swash plate 21 instead of the rotor. In this case, the rotor 19A is employed. Furthermore, instead of providing the abutment portion 29B, a recess may be provided at the location of the abutment portion 29B. In this case, the depth of the recess determines the inclination of the swash plate 21 at the maximum inclination position. In addition, the clutch mechanism, which connects and disconnects the transmission of power from the external drive source, may be eliminated.

(Second Embodiment)

To avoid a redundant description, like or same reference numerals are given to those components that are like or the same as the corresponding components of the first embodiment.

Figure 4:
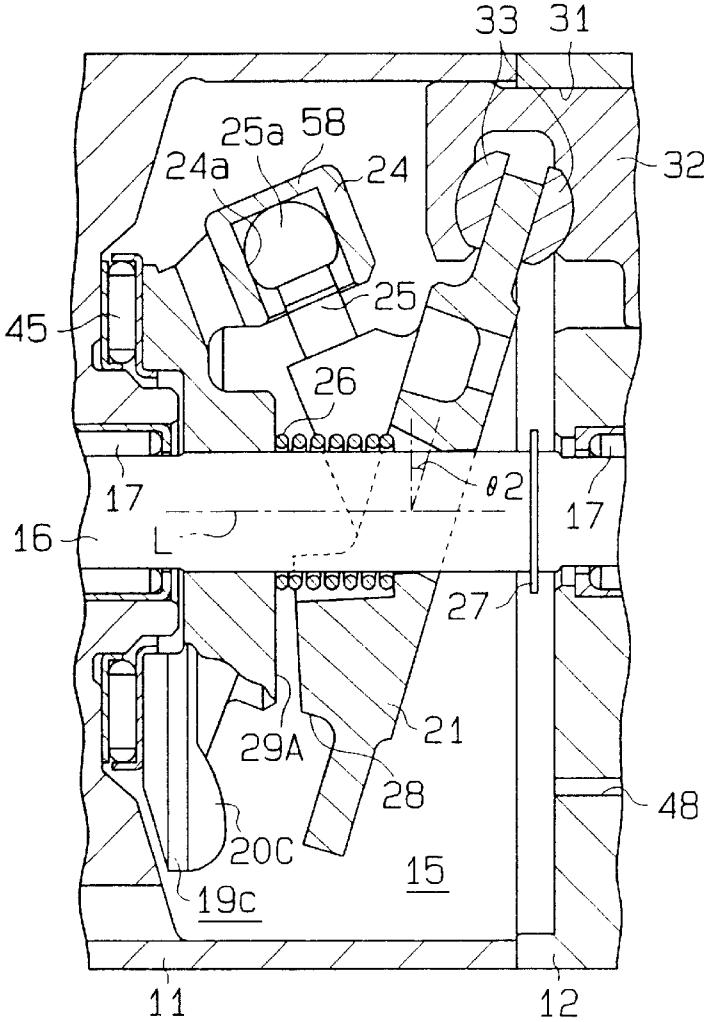
FIG. 4 is an enlarged partial view showing a second embodiment of a compressor according to the present invention.

In this embodiment, the rotor 19A of FIG. 1 is replaced with rotor 19C, as shown in FIG. 4, to alter the maximum compressor displacement. The rotor 19C differs from the rotor 19A in that caps 58 are provided in lieu of the abutment portion 29B to restrict the inclination of the swash plate 21 at the maximum inclination position. The caps 58 are formed integrally with the support arms 24 to close the opening of the associated guide bore 24*a*.

When the inclination of the swash plate 21 increases, the guides 25*a* of the connecting pins 25 abut against the associated caps 58. This restricts further inclination of the swash plate 21 and determines the maximum inclination position. The maximum inclination angle θ2 of the swash plate 21 is smaller than the maximum inclination angle θ1 of the swash plate 21, shown in FIG. 1. Therefore, the maximum displacement of this compressor is smaller than that of the compressor of FIG. 1.

The caps 58 increase the weight of the support arms 24. Accordingly, the counterweight 20C is enlarged accordingly to balance the rotation of the rotor 19C.

In this embodiment, the caps 58 or the support arms 24 change the maximum compressor displacement. Thus, except for the rotors 19A, 19C, common components may be used to assemble the compressor. This enables compressors differing in maximum displacement to be manufactured in an efficient and inexpensive manner.

The caps 58 are formed integrally with the rotor 19C. This structure reduces the number of component in comparison to a compressor using separate components to serve as the caps.

The caps 58 and the counterweight 20C satisfactorily maintain the rotating balance of the rotor 19C and enable smooth compression actions.

By preparing a number of rotors having guide bores 24*a* with caps 58 that are provided at different depths in the bores 24*a*, a number of compressors differing in maximum displacement may be manufactured. In this case, the appropriate rotor is selected from the plurality of rotors in accordance with the maximum displacement of the compressor that is to be manufactured.

Instead of employing the caps 58, stop members that restrict the movement of the support arm 24 may be provided on the connecting pins 25. Furthermore, the caps 58 need not be integral with the support arms 24 and may be separate bodies.

(Third Embodiment)

Figure 5:
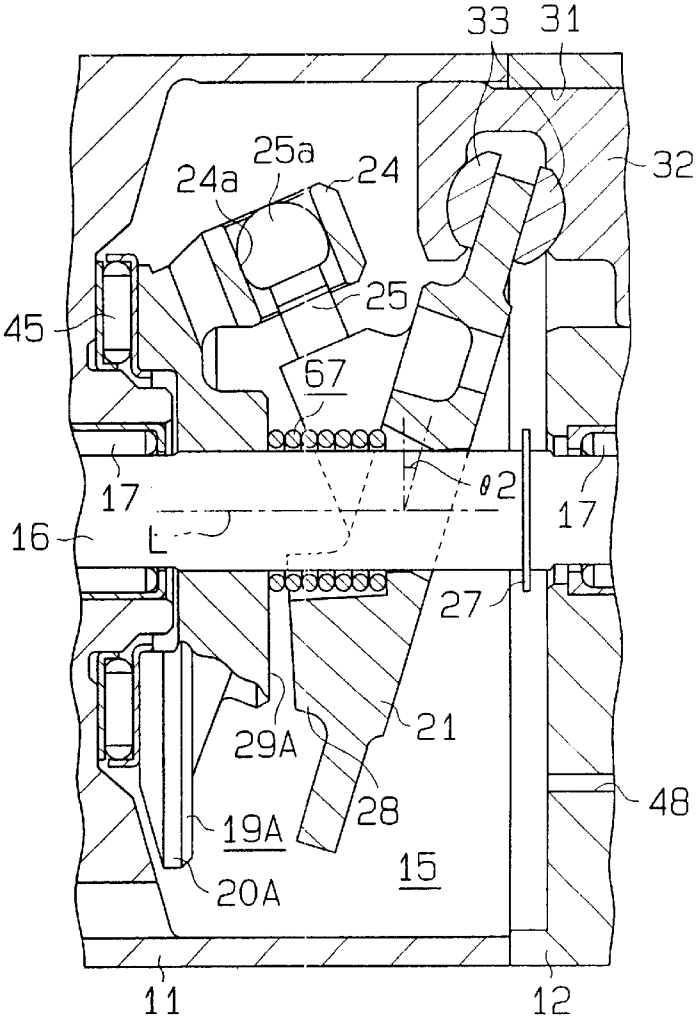
FIG. 5 is an enlarged partial view showing a third embodiment of a compressor according to the present invention.

A compressor according to a third embodiment of the present invention will now be described with reference to FIG. 5. In this embodiment, the spring 26 of FIG. 1 is replaced with a spring 67 of FIG. 5 to change the maximum compressor displacement. The number of windings of the spring 67 is greater than that of the spring 26. This results in the length of the spring 67 being longer than the length of the spring 26.

When the inclination of the swash plate 21 increases, the spring 67 becomes fully contracted before the projection 28 abuts against the rotor 19A. This restricts further inclination of the swash plate 21 and determines the maximum inclination position of the swash plate 21. As a result, the maximum displacement of the compressor is decreased.

In this embodiment, the maximum compressor displacement is changed by selectively employing the springs 26, 67, the fully contracted lengths of which differ. This enables compressors differing in maximum displacement to be manufactured in an efficient and inexpensive manner.

When employing only the spring 26 of FIG. 1, a spacer (not shown) may be arranged between the swash plate 21 and the spring 26 or between the rotor 19A and the spring 26. This changes the distance between the swash plate 21 and the rotor 19A when the spring 26 is fully contracted. In other words, the axial dimension of the spacer determined the maximum compressor displacement. This enables the employment of common springs 26.

(Fourth Embodiment)

A compressor of a fourth embodiment according to the present invention will now be described with reference to FIGS. 6 and 7.

The compressor of this embodiment differs from the compressor of FIG. 1 in that a spacer 60 is provided between the swash plate 21 and the rotor 19A. The spacer 60 is fitted to the drive shaft 16. The spacer 60 changes the inclination of the swash plate 21 at the maximum inclination position.

Figure 6:
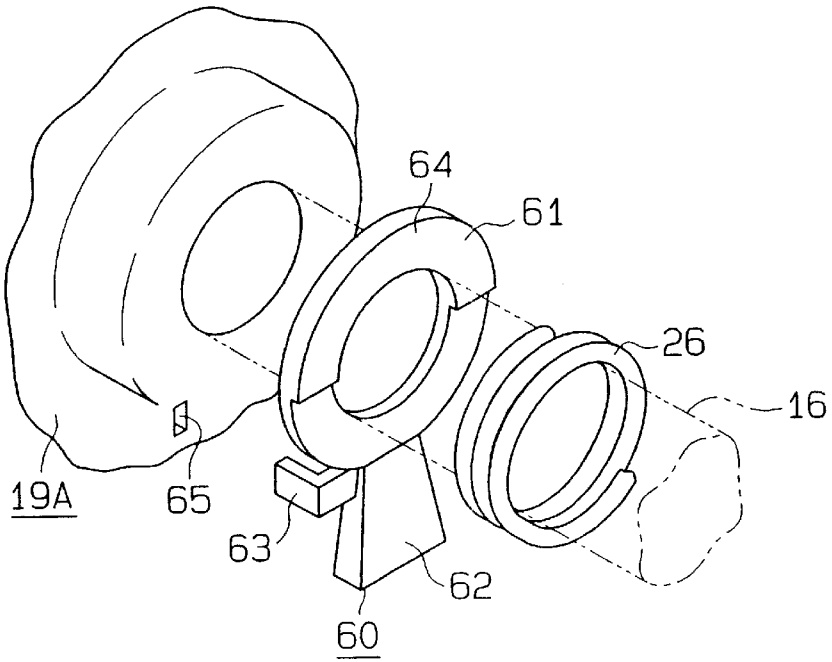
FIG. 6 is a perspective view showing a spacer employed in a fourth embodiment according to the present invention.

As shown in FIG. 6, the spacer 60 includes a receiving portion 61, an abutment portion 62, a positioner 63, and a counterweight 64. The receiving portion 61 is annular and contacts the front end of the spring 26. The abutment portion 62 is integral with the receiving portion 61 and abuts against the projection 28 of the swash plate 21. The positioner 63 is integral with the receiving portion and projects toward the rotor 19A. A hole 65 is provided in the rotor 19A. The positioner 63 is engaged with the hole 65 to position the spacer 60 and prevent relative rotation between the spacer 60 and the rotor 19A. The counterweight 64 balances the weight of the spacer 60 about the axis L of the spacer 60 in correspondence with the abutment portion 62 and the positioner 63.

Figure 7:
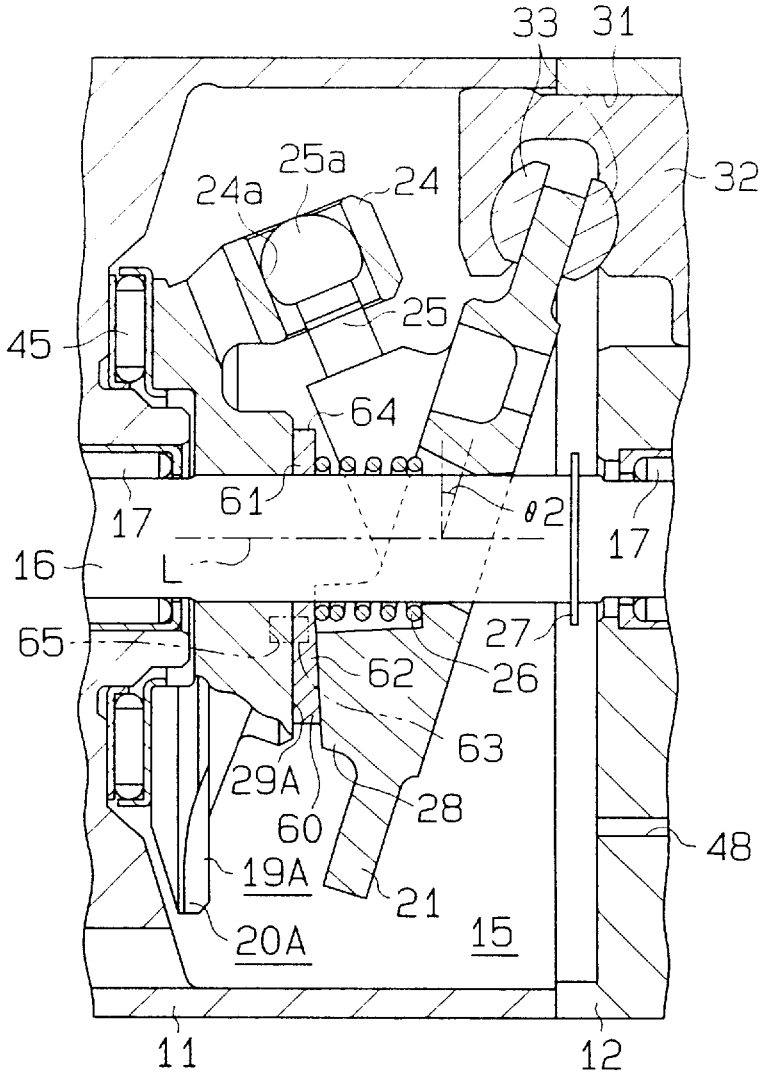
FIG. 7 is an enlarged partial view showing a compressor employing the spacer of FIG. 6.

As shown in FIG. 7, the inclination of the swash plate 21 is restricted by the abutment between the swash plate 21 and the abutment portion 62. The maximum inclination angle θ2 of the swash plate 21 is smaller than the maximum inclination angle θ1 of the swash plate 21, shown in FIG. 1. Therefore, the maximum displacement of this compressor is smaller than that of the compressor of FIG. 1.

In this embodiment, the maximum compressor displacement is altered by merely providing the spacer 60 between the rotor 19A and the swash plate 21. Accordingly, this enables compressors differing in maximum displacement to be manufactured in an efficient and inexpensive manner.

The engagement between the positioner 63 and the recess 65 holds the spacer 60 at the predetermined position even when the compressor is operating. Accordingly, the spacer 60 stabilizes the restriction of the swash plate 21 at the maximum inclination position.

The counterweight 64 balances the integral rotation of the spacer 60 and the rotor 19A and allows smooth compression actions. Furthermore, the satisfactory weight balance of the spacer 60 eliminates the need for thin portions 20*a* on the rotor 19A. Accordingly, the rotor 19A may be used as a common component. This enables the compressor to be manufactured in a further efficient and inexpensive manner.

The location of the receiving portion 61 may be changed to a position between the rear end of the spring 26 and the swash plate 21 without changing the position of the abutment portion 62. In this case, the portion connecting the abutment portion 62 with the receiving portion 61 is extended. Furthermore, the hole 65 in provided in the front side of the swash plate 21 to engage the positioner 63 of the spacer 60.

To adjust the rotating balance of the rotor 19A, the counterweight 64 of the spacer 64 may be eliminated while providing thin portions in the rotor 19A instead.

Although several embodiments of the present invention have been described so far, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. An adjustable variable displacement compressor apparatus comprising:

a housing;

a cylinder bore defined in the housing;

a piston accommodated in the cylinder bore;

a drive shaft rotatably supported in the housing;

a swash plate fitted to the drive shaft and supported to rotate integrally with the drive shaft while inclining, wherein the rotation of the swash plate causes reciprocation of the piston to draw refrigerant gas into the cylinder bore and to compress the drawn in gas, wherein the piston has a stroke that changes as the swash plate inclines;

a rotor that rotates integrally with the drive shaft;

a guiding mechanism provided between the swash plate and the rotor to guide the inclination of the swash plate to permit the swash plate to shift between a minimum inclination position and a maximum inclination position, and a restricting means located on the opposite side of the drive shaft from the guiding mechanism for determining the maximum inclination position of the swash plate, said restricting means being in the form of a spacer including a balancer arranged between the swash plate and the rotor.

2. The apparatus according to claim 1, wherein the spacer includes an engaging means for engagement with either one of the rotor and the swash plate to rotate the spacer integrally with the rotor and the swash plate.

3. An adjustable variable displacement compressor apparatus comprising:

a housing;

a cylinder bore defined in the housing;

a piston accommodated in the cylinder bore;

a drive shaft rotatably supported in the housing;

a swash plate fitted to the drive shaft and supported to rotate integrally with the drive shaft while inclining, wherein the rotation of the swash plate causes reciprocation of the piston to draw refrigerant gas into the cylinder bore and to compress the drawn in gas, wherein the piston has a stroke that changes as the swash plate inclines;

a rotor that rotates integrally with the drive shaft;

a guiding mechanism provided between the swash plate and the rotor to guide the inclination of the swash plate to permit the swash plate to shift between a minimum inclination position and a maximum inclination position; and a restricting means for determining the maximum inclination position of the swash plate, the maximum inclination position of the swash plate being determined by the particular restricting means which is disposed in the housing, said restricting means including an urging means having axial length that expands and contracts for urging the swash plate toward the minimum inclination position, the maximum inclination position of the swash plate being determined in accordance with the axial length of the urging means in a fully contracted state.

4. The apparatus according to claim 3, wherein the urging means is a coil spring, the axial length of the spring being determined in accordance with the number of windings of the spring.

5. A variable displacement compressor comprising:

a housing;

a cylinder bore defined in the housing;

a piston accommodated in the cylinder bore;

a drive shaft rotatably supported in the housing;

a swash plate fitted to the drive shaft and supported to rotate integrally with the drive shaft while inclining, wherein the rotation of the swash plate causes reciprocation of the piston to draw refrigerant gas into the cylinder bore and to compress the drawn in gas, wherein the piston has a stroke that changes as the swash plate inclines;

a rotor that rotates integrally with the drive shaft; and a guiding mechanism provided between the swash plate and the rotor to guide the inclination of the swash plate to permit the swash plate to shift between a minimum inclination position and a maximum inclination position, the guiding mechanism including a connecting pin formed integrally with the swash plate, a guiding bore defined in the rotor for slidably guiding the pin, and a restricting means to restrict the maximum inclination position of the swash plate, wherein the pin abuts against the restricting means, the maximum inclination position of the swash plate being determined in accordance with the abutment position of the restricting means and the connecting pin.

6. The compressor according to claim 5, wherein the restricting means includes a cap for blocking the guide bore.

7. A variable displacement compressor comprising:

a housing;

a cylinder bore defined in the housing;

a piston accommodated in the cylinder bore;

a drive shaft rotatably supported in the housing;

a swash plate fitted to the drive shaft and supported to rotate integrally with the drive shaft while inclining, wherein the rotation of the swash plate causes reciprocation of the piston to draw refrigerant gas into the cylinder bore and to compress the drawn in gas, wherein the piston has a stroke that changes as the swash plate inclines;

a rotor that rotates integrally with the drive shaft;

a guiding mechanism provided between the swash plate and the rotor to guide the inclination of the swash plate to permit the swash plate to shift between a minimum inclination position and a maximum inclination position; and a restricting means arranged to cooperate with the swash plate and the rotor to restrict the maximum inclination position of the swash plate, the restricting means urging the swash plate toward the minimum inclination position, the axial length of the restricting means being variable, and the maximum inclination position of the swash plate being determined in accordance with the length of the restricting means when the restricting means is in its shortest state.

8. The compressor according to claim 7, wherein the restricting means includes a coil spring, the axial length of the spring being adjusted in accordance with the number of windings of the spring and the maximum inclination position of the swash plate being determined in accordance with the length of the spring.

9. The compressor according to claim 8, wherein the coil spring is wound about the drive shaft and is coaxial to the drive shaft.

10. An adjustable variable displacement compressor apparatus comprising:

a housing;

a cylinder bore defined in the housing;

a piston accommodated in the cylinder bore;

a drive shaft rotatably supported in the housing;

a swash plate fitted to the drive shaft and supported to rotate integrally with the drive shaft while inclining, wherein the rotation of the swash plate causes reciprocation of the piston to draw refrigerant gas into the cylinder bore and to compress the drawn in gas, wherein the piston has a stroke that changes as the swash plate inclines;

a rotor that rotates integrally with the drive shaft;

a guiding mechanism provided between the swash plate and the rotor to guide the inclination of the swash plate to permit the swash plate to shift between a minimum inclination position and a maximum inclination position, said guiding mechanism including a connecting pin formed integrally with the swash plate and a guiding bore defined in the rotor for slidably guiding the pin; and a restricting means for determining the maximum inclination position of the swash plate, the maximum inclination position of the swash plate being determined by providing a selected one of the restricting means in the housing where the connecting pin can abut against the restricting means to restrict movement of the swash plate.

* * * * *

UNITED STATES PATENT AND TRADEMARK OFFICE

CERTIFICATE OF CORRECTION

PATENT NO. : 5,857,402

DATED : January 12, 1999

INVENTOR(S) : Hoshida et al.

It is certified that error appears in the above-identified patent and that said Letters Patent is hereby corrected as shown below:

Column 1, line 59, change "awash" to --swash--.

Column 3, line 19, change reference numeral "27" to--21--.

Column 3, line 28, change reference numeral "23" to --21--.

Column 4, line 9, change "passeage" to --passage--.

Signed and Sealed this

Third Day of October, 2000

*Attest:*

*Attesting Officer*

Q. TODD DICKINSON

*Director of Patents and Trademarks*